US005148784A

United States Patent [19]

Hiraoka et al.

[11] Patent Number: 5,148,784

[45] Date of Patent: Sep. 22, 1992

[54] STRUCTURE OF INTERNAL COMBUSTION ENGINE

[75] Inventors: Toyoki Hiraoka, Tokyo; Syuji Kurosaka, Kawasaki; Nobuhisa Jingu, Yokohama, all of Japan

[73] Assignee: Nissan Motor Co., Ltd., Yokohama, Japan

[21] Appl. No.: 686,343

[22] Filed: Apr. 18, 1991

[30] Foreign Application Priority Data

May 1, 1990 [JP] Japan ..... 2-115407

[51] Int. Cl.[5] ..... F02F 7/00

[52] U.S. Cl. ..... 123/195 C; 123/41.01

[58] Field of Search ..... 123/41.01, 195 C, 198 B, 123/41.86, 195 R

[56] References Cited

U.S. PATENT DOCUMENTS 4,448,159 5/1984 Hidaka et al. ..... 123/195 C

FOREIGN PATENT DOCUMENTS 63-115508 7/1988 Japan .

64-6330 1/1989 Japan .

0170710 7/1989 Japan ..... 123/41.01

*Primary Examiner*—Noah P. Kamen

*Attorney, Agent, or Firm*—Foley & Lardner

[57] ABSTRACT

An internal combustion engine comprises a cylinder block including a front wall, and a chain cover attached to the front wall. Coolant passage walls defining a coolant passage are integrated with the front wall of the cylinder block and the chain cover, respectively. Heat insulating means are arranged to prevent a contact of lubricating oil and blow-by gas with the coolant passage walls.

5 Claims, 6 Drawing Sheets

STRUCTURE OF INTERNAL COMBUSTION ENGINE

BACKGROUND OF THE INVENTION

The present invention relates to a structure of an internal combustion engine.

Referring to FIGS. 5 and 6, there is shown a known structure of an internal combustion engine (see JP-U 63-115508 and JP-U 64-6330).

Referring to FIGS. 5 and 6, a chain chamber 65 for receiving a crank chain 64 is defined by a front wall 62 of a cylinder block 61 and a crank chain cover 63 to be attached thereto. The chain chamber 65 serves to return lubricating oil out of two cylinder heads 66 to an oil pan 67, and to lead also blow-by gas within a crank chamber 68 to two head covers 69. A coolant passage 72 is transversely arranged in the chain chamber 65 to fluidly communicate a water pump 70 with a water gallery 71 of the cylinder block 61.

With such known structure of an internal combustion chamber, however, since the coolant passage 72 is transversely arranged in the chain chamber 65, lubricating oil and blow-by gas are refrigerated by coming into direct contact with walls 73 and 74 which define the coolant passage 72, generating water droplets due to condensation of a moisture content contained therein, resulting in production of sludge.

Specifically, when coming into direct contact with the walls 73 and 74 of the coolant passage 72, lubricating oil and blow-by gas are refrigerated to generate water droplets. Nitrogen oxides $NO_x$ in blow-by gas are dissolved in the water droplets, and a following chemical reaction is produced:

$$H_2O + NO_x = HNO_2, HNO_3$$

These $HNO_2$, $HNO_3$ and unburnt gas HC are reacted in lubricating oil stored in the oil pan 67, generating sludge binder. Carbon, additive, soil and the like mix therewith, finally producing sludge which accumulates in the oil pan 67, causing a deficit in lubricating oil, and a premature deterioration of the engine.

SUMMARY OF THE INVENTION

It is, therefore, an object of the present invention to provide an internal combustion engine which has less generation of water droplets due to condensation of moisture content contained in lubricating oil and blow-by gas.

It is another object of the present invention to provide an internal combustion engine which has reduced accumulation of sludge in an oil pan.

It is still another object of the present invention to provide an internal combustion engine which assumes an excellent lubrication performance for a long time.

There is provided, according to the present invention, an internal combustion engine comprising:

a cylinder block including one wall;

a chain cover attached to said one wall of said cylinder block;

means for defining a coolant passage, said defining means being integrated with said one wall of said cylinder block and said chain cover; and means for thermally isolating said defining means.

DETAILED DESCRIPTION OF THE INVENTION

Figure 1:
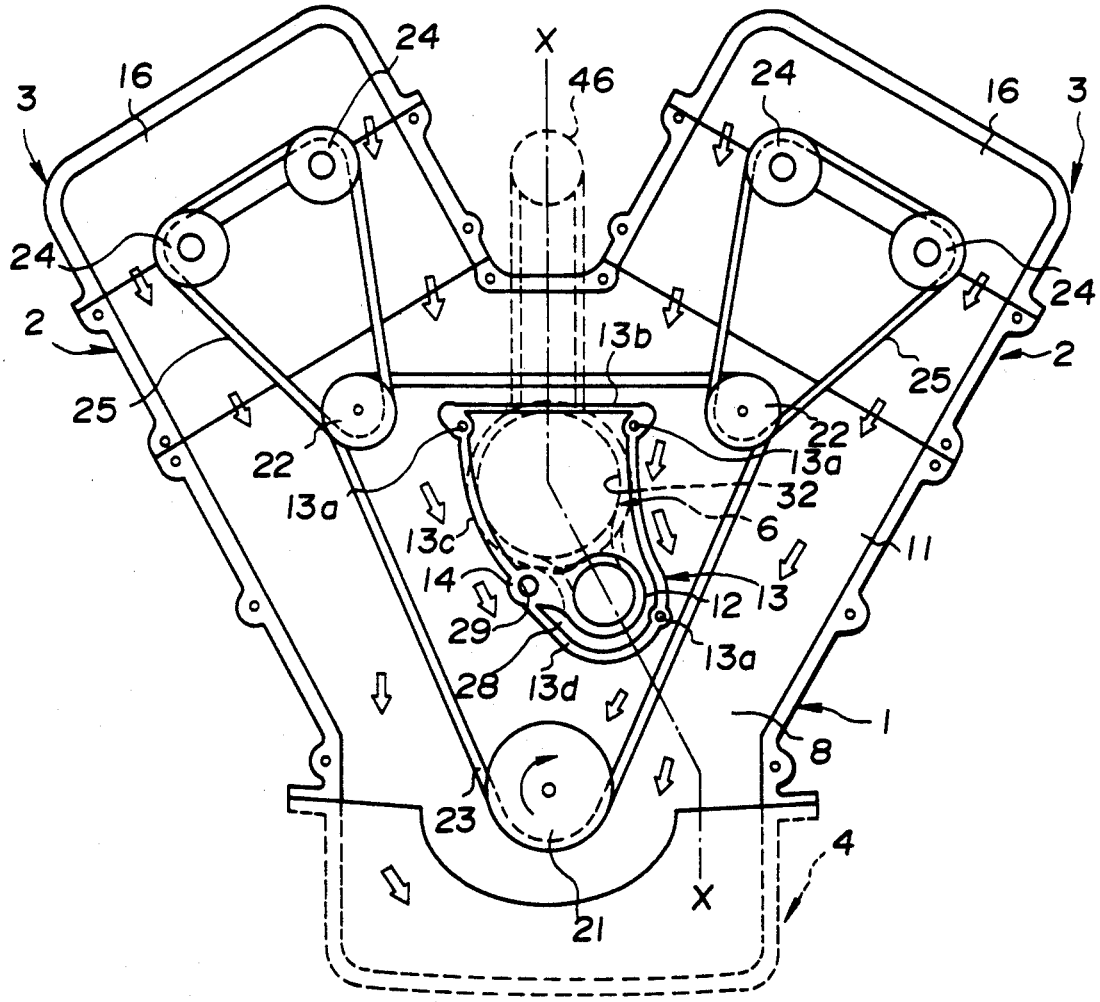
FIG. 1 is a front view illustrating a first preferred embodiment of an internal combustion engine, with cam and crank chain covers detached, according to the present invention.
Figure 2:
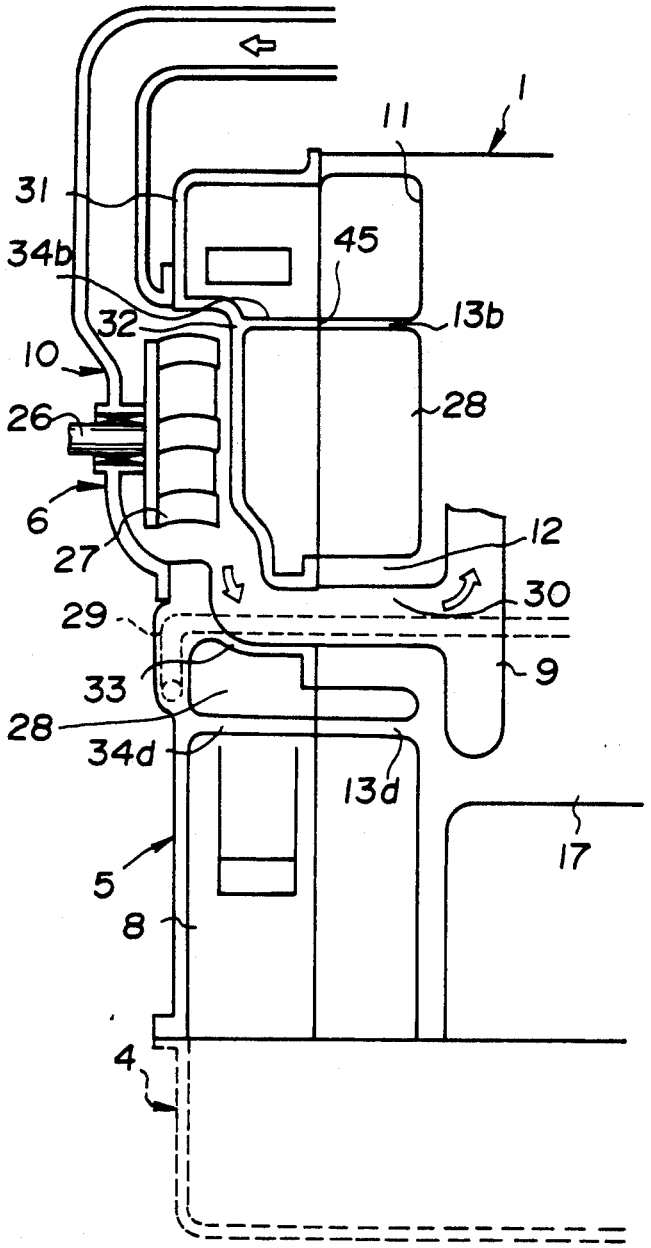
FIG. 2 is a longitudinal section taken along the line X—X of FIG. 1, with the crank chain cover.
Figure 3:
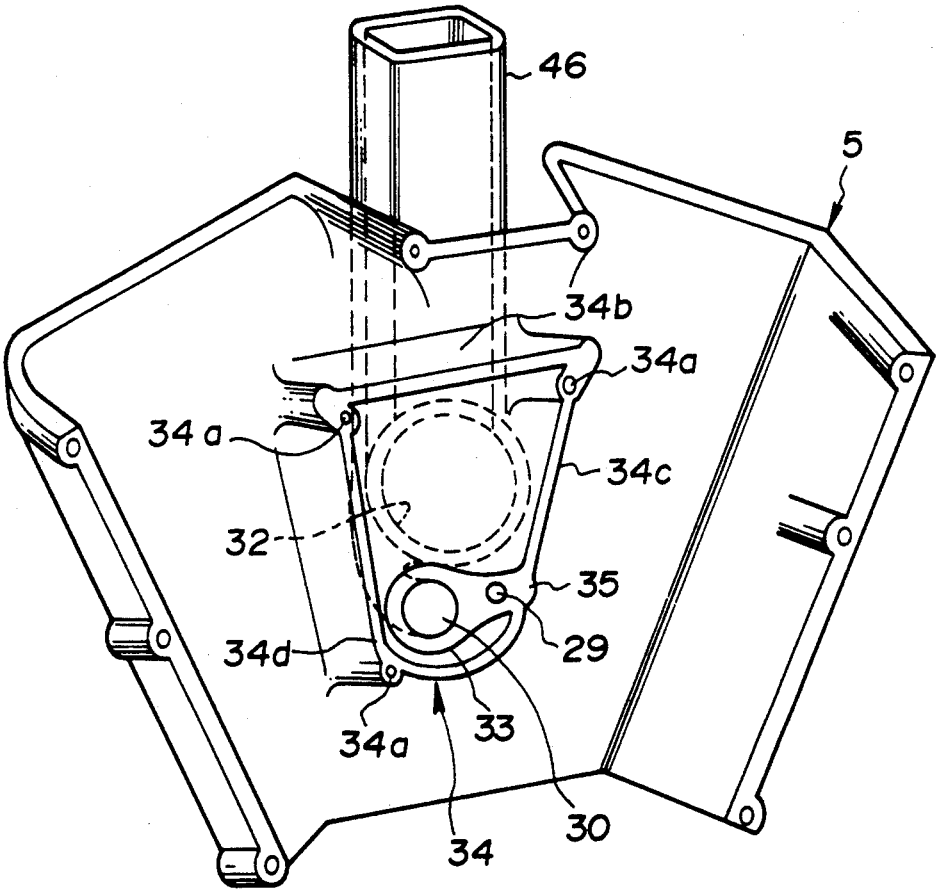
FIG. 3 is a perspective view illustrating the crank chain cover.

Referring to the drawings, particularly to FIGS. 1 to 3, a V-type engine includes a cylinder block 1 which bifurcates into right and left banks, two cylinder heads 2, two cam covers 3, and an oil pan 4.

Referring to FIG. 1, a crank chain 23 drivingly interconnects a crank sprocket 21 and two intermediate sprockets 22 on a front wall 11 of the cylinder block 1, whereas a camshaft chain 25 drivingly interconnects each intermediate sprocket 22 and a pair of cam sprockets 24 which are arranged to each bank, thus transmitting engine torque to a valve actuating system arranged on each cylinder head 2.

Referring also to FIG. 2, a crank chain cover 5 is attached to the front wall 11 of the cylinder block 1, whereas two camshaft chain covers (not shown) are attached to the cylinder heads 2, respectively, thus defining between the two a chain chamber 8 to receive the sprockets 21, 22, 24, and the chains 23, 25.

The chain chamber 8 is in fluid communication with two cam chambers 16, a crank chamber 17, and the oil pan 4. Accordingly, lubricating oil out of the cylinder heads 2 is returned to the oil pan 4 via the chain chamber 8 as indicated by void arrows in FIG. 1.

Additionally, blow-by gas as blown from a clearance between a piston and a cylinder into the crank chamber 17 is introduced in the cam chambers 16 via the chain chamber 8, then returned to an intake system of the engine via gas pipes (not shown) connecting with the cam chambers 16.

Referring particularly to FIG. 2, a water pump 6 is mounted to the chain cover 5 at the front center portion thereof. A pump housing 10 is mounted on a front wall 31 of the chain cover 5. Vanes 27 are received between the two. Engine torque is transmitted to the vanes 27 through a shaft 26 rotatably supported by the pump housing 10, and a pulley and a belt (not shown). When rotating the vanes 27, coolant is sucked via a suction pipe 46 integrated with the pump housing 10 as indicated by void arrows in FIG. 2, then transported into a water gallery 9 on the side of the cylinder block 1 via a coolant passage 30 which is transversely arranged in the chain chamber 8.

Referring particularly to FIG. 3, the chain cover 5 is integrally formed with a pump casing wall 32 surrounding the vanes 27, and a tubular coolant wall 33 defining the coolant passage 30.

The cylinder block 1 has a coolant passage wall 12 defining the coolant passage 30, which is tubularly protruded from the front wall 11. As shown in FIG. 2, when securing the chain cover 5 to the cylinder block 1 with a plurality of bolts (not shown), the coolant passage 12 on the side of the cylinder block 1 is united with the coolant passage 33 on the side of the chain cover 5, thus defining the coolant passage 30 to be transversely arranged in the chain chamber 8.

The water gallery 9 serves to lead coolant to the cylinder block 1, and the cylinder heads 2 of the right and left banks.

The chain cover 5, and the cylinder block 1 an oil gallery 29 to be transversely arranged in the chain chamber 8 so as to supply each part of engine with lubricating oil out of an oil pump (not shown). The chain cover 5, and the cylinder block 1 are integrally formed with oil passage walls 35 and 14, respectively, to define the oil gallery 29 in the vicinity of the coolant passages 33 and 12.

Referring to FIGS. 1 and 3, heat insulating means are arranged to prevent a contact of lubricating oil and blow-by gas with the coolant passage walls 12 and 33. That is, a partition wall 13 protrudes from the front wall 11 of the cylinder block 1, whereas a partition wall 34 protrudes from the chain cover 5 so as to unite with the partition wall 13. An oil seal 45 is arranged to hermetically seal a junction of the partition walls 13 and 34, thus having an air layer 28 around the coolant passage walls 12 and 33 as shown in FIG. 2.

The partition walls 13 includes three bolt bosses 13*a*, an upper wall portion 13*b* arranged above the pump casing wall 32 for receiving the vanes 27 in a substantially horizontal manner, a right wall portion 13*c* arranged to connect the upper wall portion 13*b* to the oil passage wall 14, and a left wall portion 13*d* arranged to connect the upper wall portion 13*b* to the oil passage wall 14, and at predetermined intervals relative to the coolant passage wall 12. Similarly, the partition wall 34 includes three bolt bosses 34*a*, an upper wall portion 34*b*, a right wall portion 34*c*, and a left wall portion 34*d*.

Next, the operation of this embodiment will be described.

The chain chamber 8 fluidly communicates the cam chambers 16 arranged on the cylinder heads 2 with the oil pan 4, and the crank chamber 17. Thus, lubricating oil out of the cylinder heads 2 is returned to the oil pan 4 via the chain chamber 8 as indicated by void arrows in FIG. 1. Additionally, blow-by gas as blown from each cylinder into the crank chamber 17 is introduced in the cam chamber 16 via the chain chamber 8, then returned to the intake system of the engine via the gas pipes (not shown) connecting with the cam chambers 16.

Since the temperature of coolant is kept relatively low by a radiator, the temperature of the coolant passage walls 12 and 33 in which coolant circulates is decreased relative to same of the other walls defining the chain chamber 8.

In this embodiment, since the coolant passage walls 12 and 33 in which coolant circulates are surrounded by the partition walls 13 and 34 through the air layer 28 as the heat insulating means, lubricating oil and blow-by gas passing through the chain chamber 8 do not come in direct contact with the coolant passage walls 12 and 33, and the temperature of the partition walls 13 and 34 is thus relatively high compared with same of the coolant passage walls 12 and 33. As a result, even if lubricating oil and blow-by gas passing through the chain chamber 8 come in contact with the partition walls 13 and 34, a drop in temperature thereof is restrained within a small value.

Accordingly, lubricating oil and blow-by gas are not refrigerated by the coolant passage 30 which is transversely arranged in the chain chamber 8, thus restraining generation of water droplets due to condensation of moisture contained therein.

This effectively prevents a following process:

Nitrogen oxides $NO_x$ in blow-by gas are dissolved in the water droplets, and a following chemical reaction is produced: $H_2O+NO_x=HNO_2$, $HNO_3$. These $HNO_2$, $HNO_3$ and unburnt gas HC are reacted in lubricating oil stored in the oil pan 4, generating sludge binder. Carbon, additive, soil and the like mix therewith, finally producing sludge which accumulates in the oil pan 4.

Figure 4:
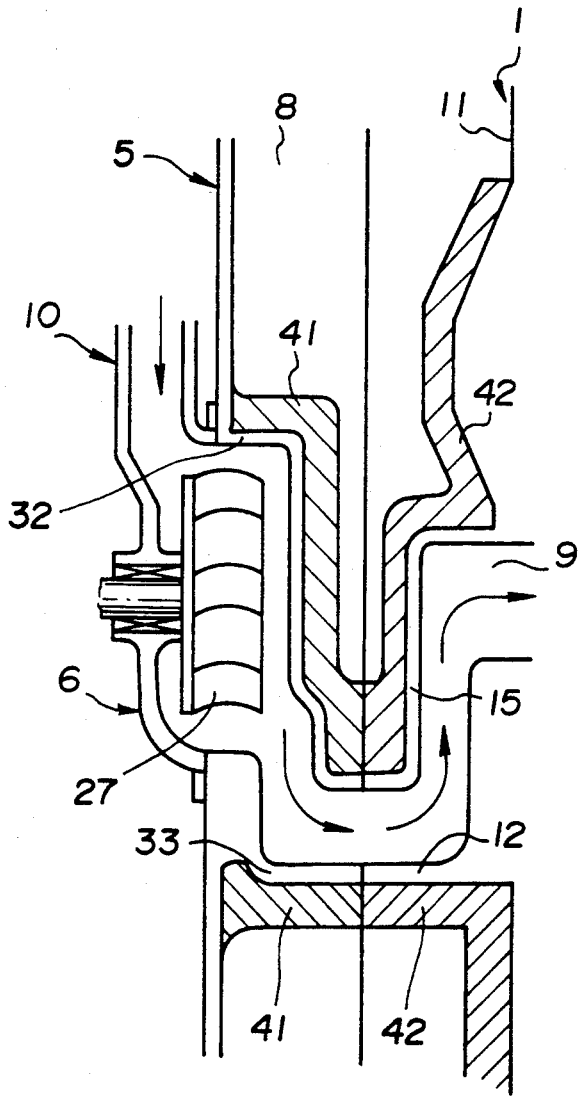
FIG. 4 is a view similar to FIG. 2, illustrating a second preferred embodiment of an internal combustion engine according to the present invention.
Figure 5:
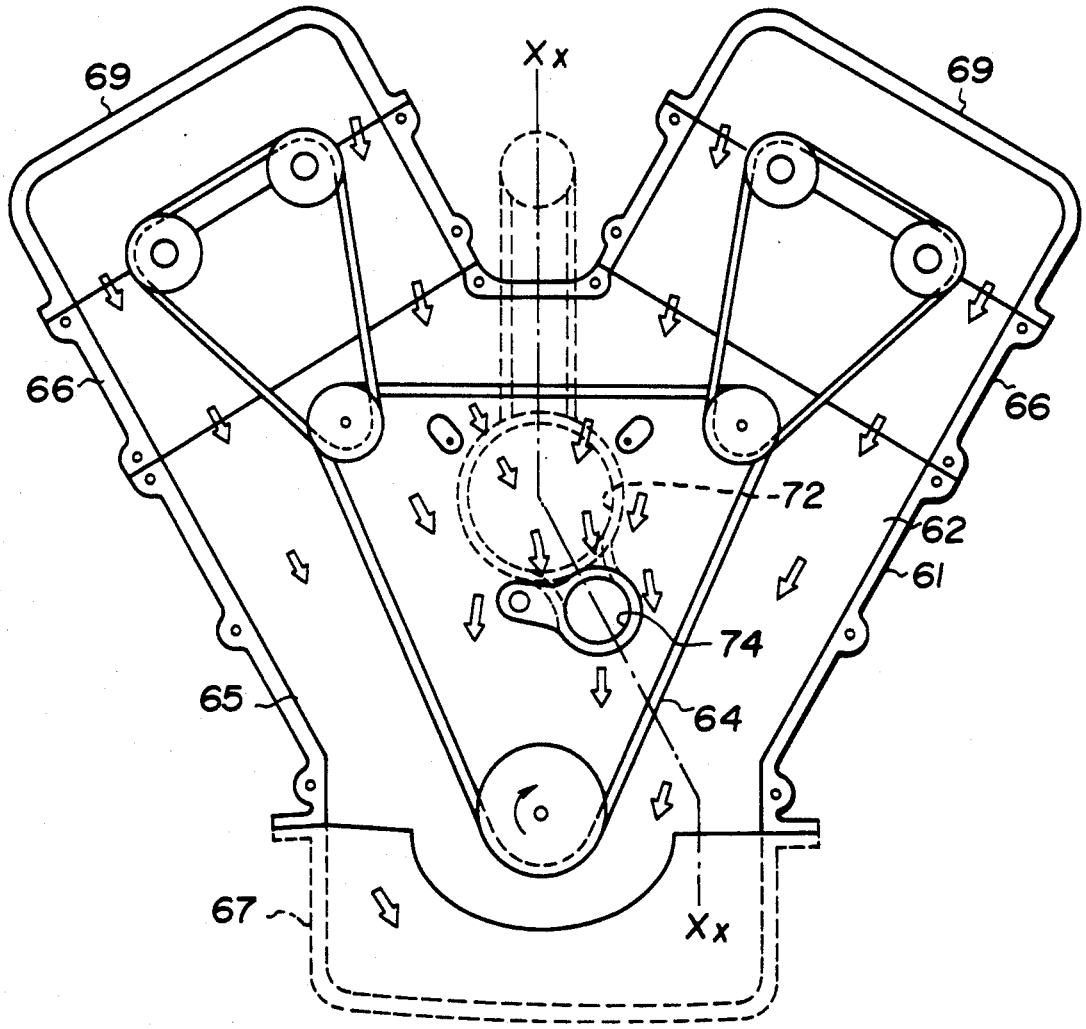
FIG. 5 (PRIOR ART)
FIG. 5 is a view similar to FIG. 1, illustrating a known internal combustion engine.
Figure 6:
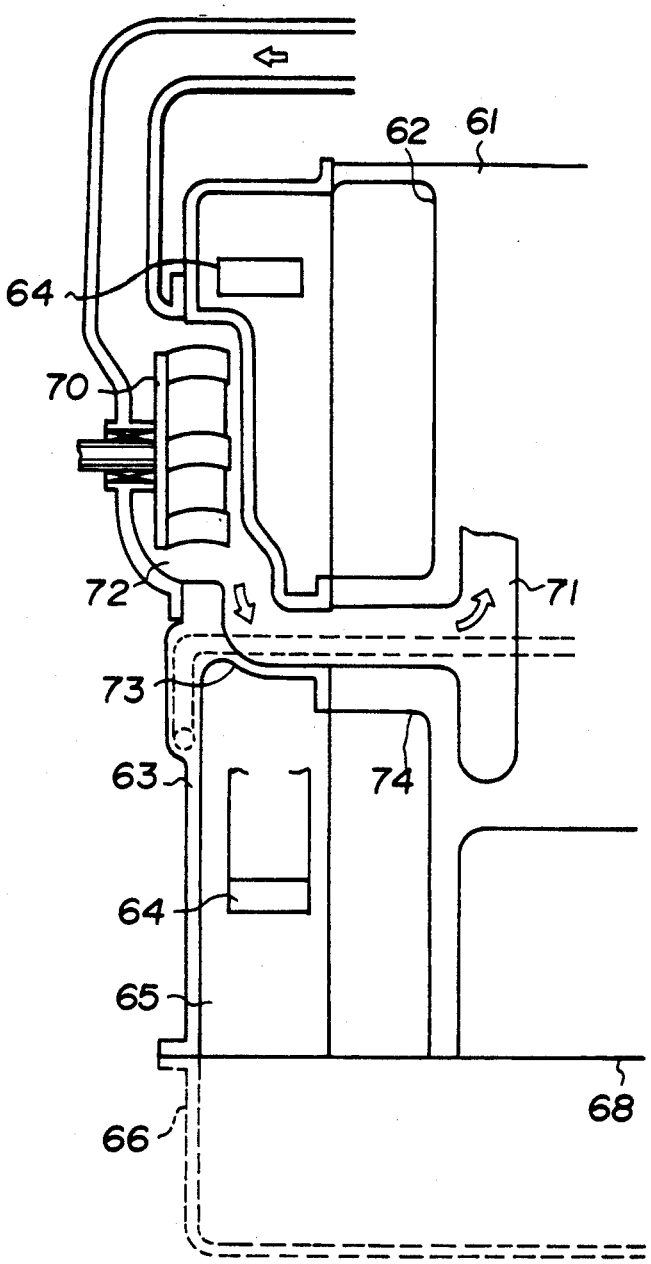
FIG. 6 (PRIOR ART)
FIG. 6 is a view similar to FIG. 4, taken along the line $X_x$—$X_x$ of FIG. 5.

Referring to FIG. 4, a second preferred embodiment of the present invention will be described.

Arranged as the heat insulating means for preventing a contact of lubricating oil and blow-by gas with the coolant passage walls 12 and 33 are a heat insulator 41 placed on the pump casing wall 32 and the coolant passage wall 33 of the chain cover 5 which surround the vanes 27, and a heat insulator 42 placed on the coolant passage wall 12, a wall portion 15 for defining the water gallery 9, and the front wall 11 of the cylinder block 1.

The heat insulators 41 and 42 are made of a material having a low heat conductivity such as a urethane form.

In this embodiment, also, lubricating oil and blow-by gas passing through the chain chamber 8 do not come in direct contact with the pump casing wall 32, and the coolant passage walls 12 and 33 refrigerated by coolant, and the temperature thereof is kept substantially constant, effectively preventing generation of sludge due to low temperature.

What is claimed is:

1. An internal combustion engine having a lubricating oil and a blow-by gas passing through a chain chamber, comprising:

a cylinder block having a front wall;

a chain cover, attached to said front wall of said cylinder block, for defining the chain chamber;

means for defining a coolant passage, said defining means being integrated with said front wall of said cylinder block and said chain cover, said defining means extending through the chain chamber; and means for thermally isolating said defining means from the lubricating oil and the blow-by gas.

2. An internal combustion engine as claimed in claim 1, wherein said thermally isolating means includes:

a first partition wall integrated with said front wall of said cylinder block, said first partition wall surrounding said defining means;

a second partition wall integrated with said chain cover, said second partition wall surrounding said defining means, said second partition wall abutting upon said first partition wall; and an oil seal arranged between said first and second partition walls.

3. An internal combustion engine as claimed in claim 1, wherein said thermally isolating means includes a heat insulator placed on said defining means.

4. An internal combustion engine as claimed in claim 3, wherein said heat insulator includes an urethane foam.

5. An internal combustion engine including a cylinder block having a front wall, a chain chamber, and a crank chamber; a cylinder head disposed on the cylinder block and having a cam chamber and a front wall; a cam cover, attached to the cylinder head, for defining the cam chamber; a chain cover, attached to the cylinder block and the cylinder head on the front walls thereof, for defining the chain chamber; and an oil pan, mounted to the cylinder block, for defining the crank chamber; the engine having a lubricating oil which is returned to the oil pan from the cam chamber via the chain chamber and a blow-by gas which is blown into the crank chamber and introduced in the cam chamber via the chain chamber, the engine comprising:

means for defining a coolant passage, said defining means being integrated with the front wall of the cylinder block and the chain cover, said defining means extending through the chain chamber; and means for thermally isolating said defining means from the lubricating oil and the blow-by gas.

* * * * *